US010246106B2

(12) United States Patent
Davis et al.

(10) Patent No.: US 10,246,106 B2
(45) Date of Patent: Apr. 2, 2019

(54) FLOORING INCORPORATING OPEN AND ENCLOSED AIR DUCTS

(71) Applicant: Union Pacific Railroad Company, Omaha, NE (US)

(72) Inventors: Brian Lester Davis, Saint Charles, MO (US); John Patrick Birkmann, Saint Charles, MO (US); Mark Russell Horne, DeSoto, MO (US)

(73) Assignee: Union Pacific Railroad Company, Omaha, NE (US)

( * ) Notice: Subject to any disclaimer, the term of this patent is extended or adjusted under 35 U.S.C. 154(b) by 281 days.

(21) Appl. No.: 14/811,624

(22) Filed: Jul. 28, 2015

(65) Prior Publication Data

US 2017/0028998 A1 Feb. 2, 2017

(51) Int. Cl.
*B61D 17/10* (2006.01)

(52) U.S. Cl.
CPC ..... *B61D 17/10* (2013.01)

(58) Field of Classification Search
CPC ..... B61D 17/00; B61D 17/04; B61D 17/041; B61D 17/10
See application file for complete search history.

(56) References Cited

U.S. PATENT DOCUMENTS 3,092,220 A * 6/1963 Black ..... B60P 3/20 105/375
4,091,743 A * 5/1978 Lemon ..... B60P 3/20 105/375
4,269,443 A * 5/1981 Farmer ..... B60P 3/42 105/418
6,722,287 B2 * 4/2004 Norton ..... B61D 17/005 105/404

* cited by examiner

*Primary Examiner* — Robert J McCarry, Jr.
(74) *Attorney, Agent, or Firm* — Kutak Rock LLP; Sean P. Connolly

(57) ABSTRACT

Herein described are at least an elongated flooring unit and a floor. In one embodiment, an elongated flooring unit includes a left web, a right web, a top flange, and a bottom flange, in which the top flange is positioned parallel to the bottom flange. The left and right webs, and the top and bottom flanges, enclose an air space configured for use as an air duct. In one embodiment, a floor includes a plurality of alternating enclosed air ducts and open air ducts formed by interconnecting a plurality of flooring units, in which each enclosed air duct of the enclosed air ducts is formed by two webs and two flanges of each flooring unit of the plurality of flooring units, and in which the two flanges include a bottom flange and a top flange.

40 Claims, 6 Drawing Sheets

FLOORING INCORPORATING OPEN AND ENCLOSED AIR DUCTS

BACKGROUND

A railcar floor may be constructed by attaching materials over the underframe of a railcar. When the railcar is a refrigerated insulated box car, the flooring should provide adequate air circulation and thermal insulation to the lading of the railcar. Often, the railcar floor may not provide suitable airflow underneath the lading. This may result in spoilage of perishable products being transported by the railcar. In some instances, the railcar floor may be unable to withstand normal use and operation. In addition, the railcar floor may not provide a suitable structure to easily wash or clean the floor. Accordingly, there remains a need to improve the refrigeration characteristics, strength, and washability of a railcar's floor.

SUMMARY

In light of the foregoing background, and other shortcomings, the following presents a simplified summary of the present disclosure in order to provide a basic understanding of some aspects described herein. This summary is not an extensive overview and is provided merely to introduce certain concepts, and is not intended to identify key or critical elements or to delineate the scope of the claims. The following summary merely presents some aspects in a simplified form as a prelude to the more detailed description that follows.

Various aspects and representative embodiments of a floor and/or flooring unit are substantially shown in and/or described in connection with at least one of the following figures.

These and other advantages, aspects, and novel features of the present disclosure, as well as details of illustrated embodiments thereof, will be more fully understood from the following description and drawings.

BRIEF DESCRIPTION OF THE DRAWINGS

Figure 1:
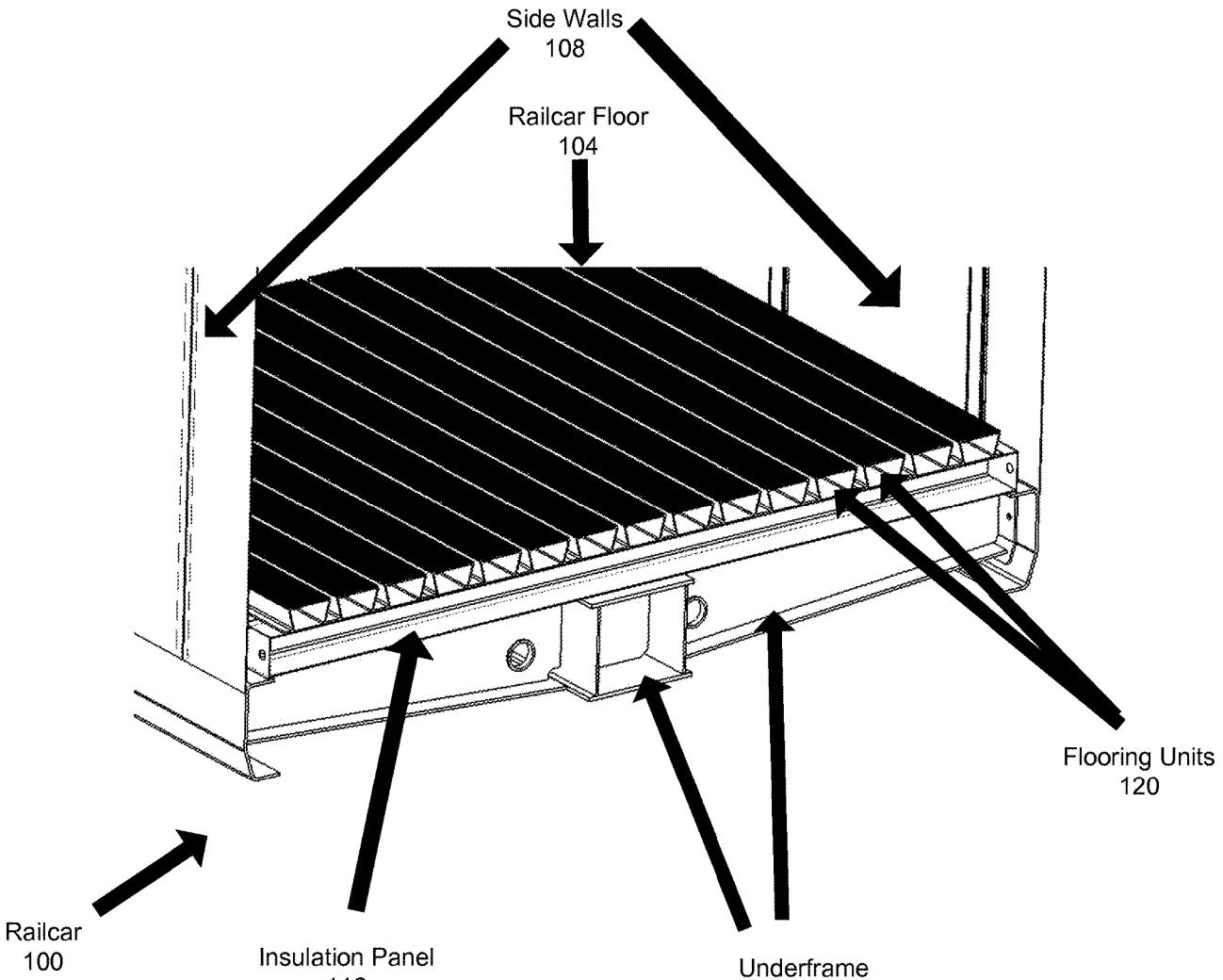

Having thus described aspects of the disclosure in general terms, reference will now be made to the accompanying drawings in which some features are illustrated by way of example, which are not necessarily drawn to scale, and wherein:

FIG. 1 is an example perspective view of a railcar floor within a railcar in accordance with various embodiments.

Figure 2:
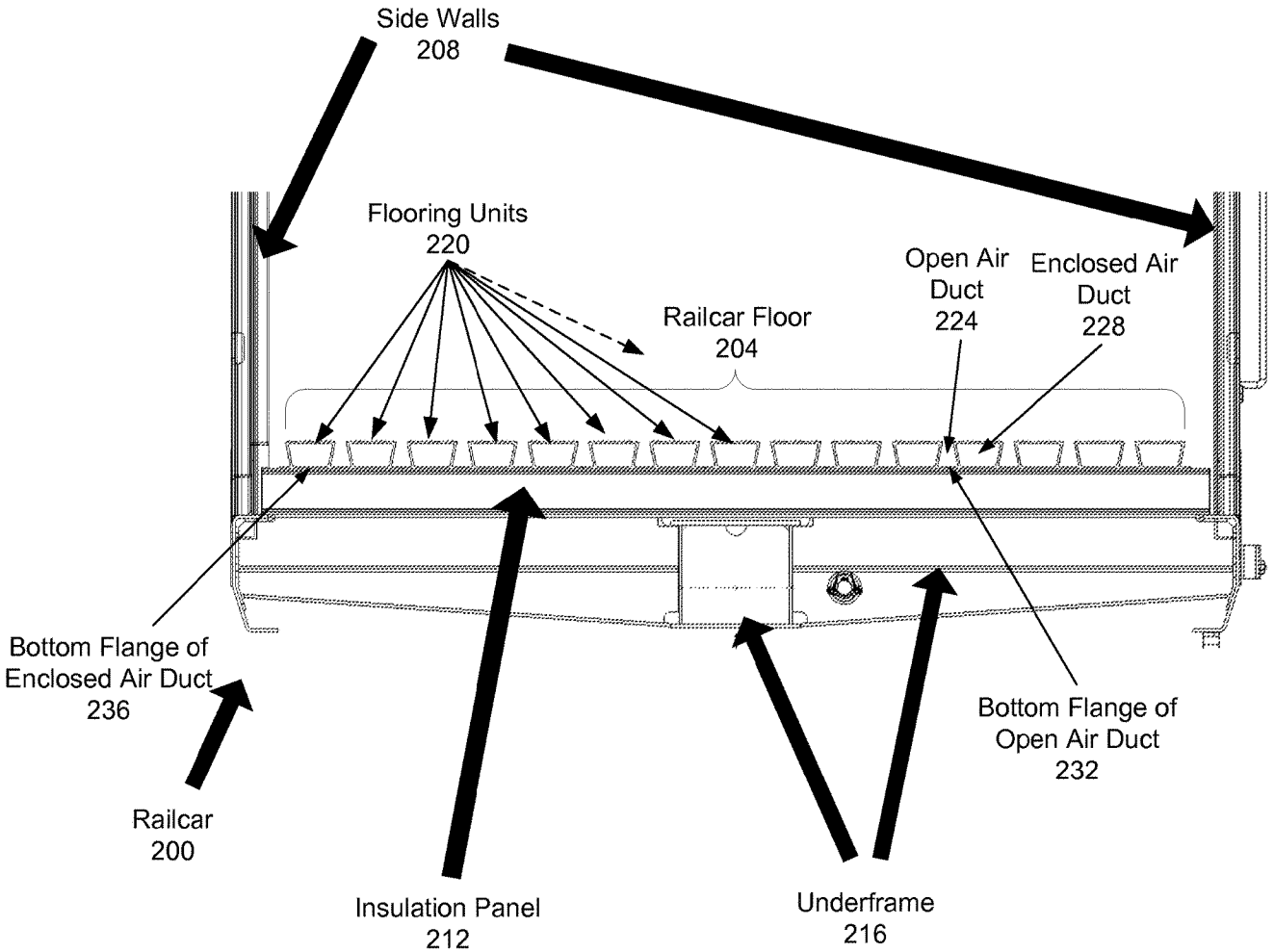

FIG. 2 depicts an example cross-section of a railcar floor within a railcar in accordance with various embodiments.

Figure 3:
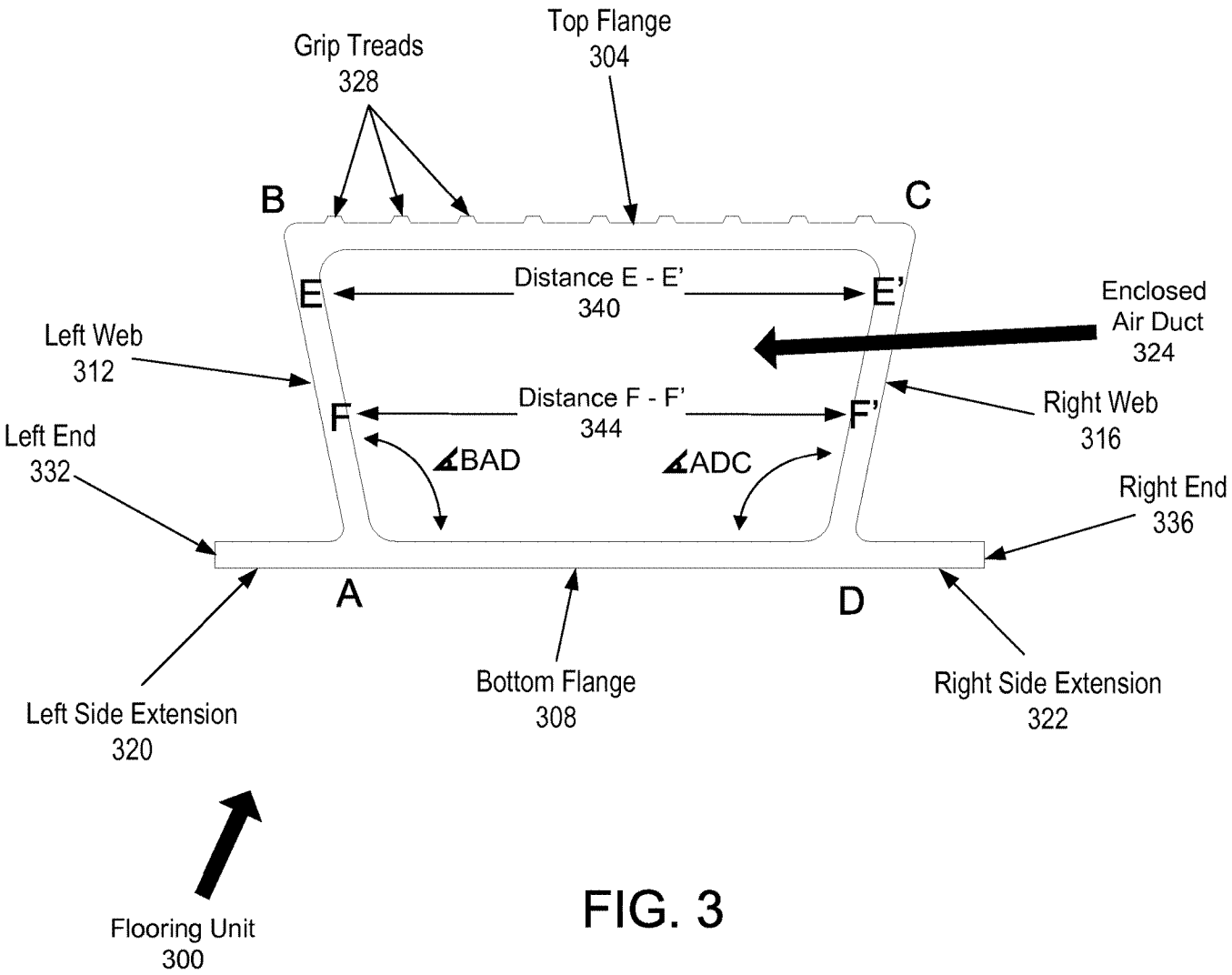

FIG. 3 depicts an example cross-section of a flooring unit in accordance with various embodiments.

Figure 4:
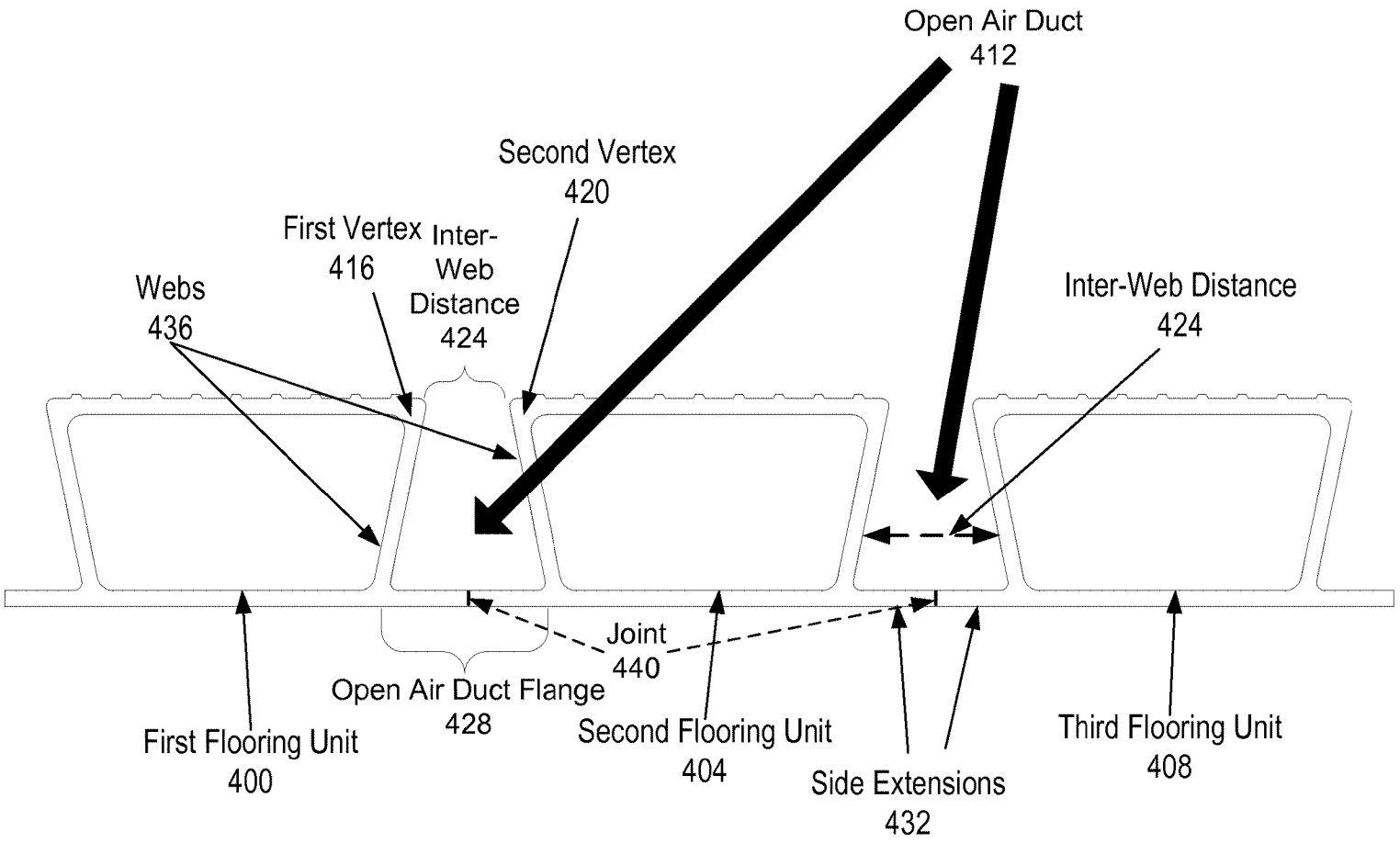

FIG. 4 depicts an example cross-section of interconnected flooring units in accordance with various embodiments.

Figure 5:
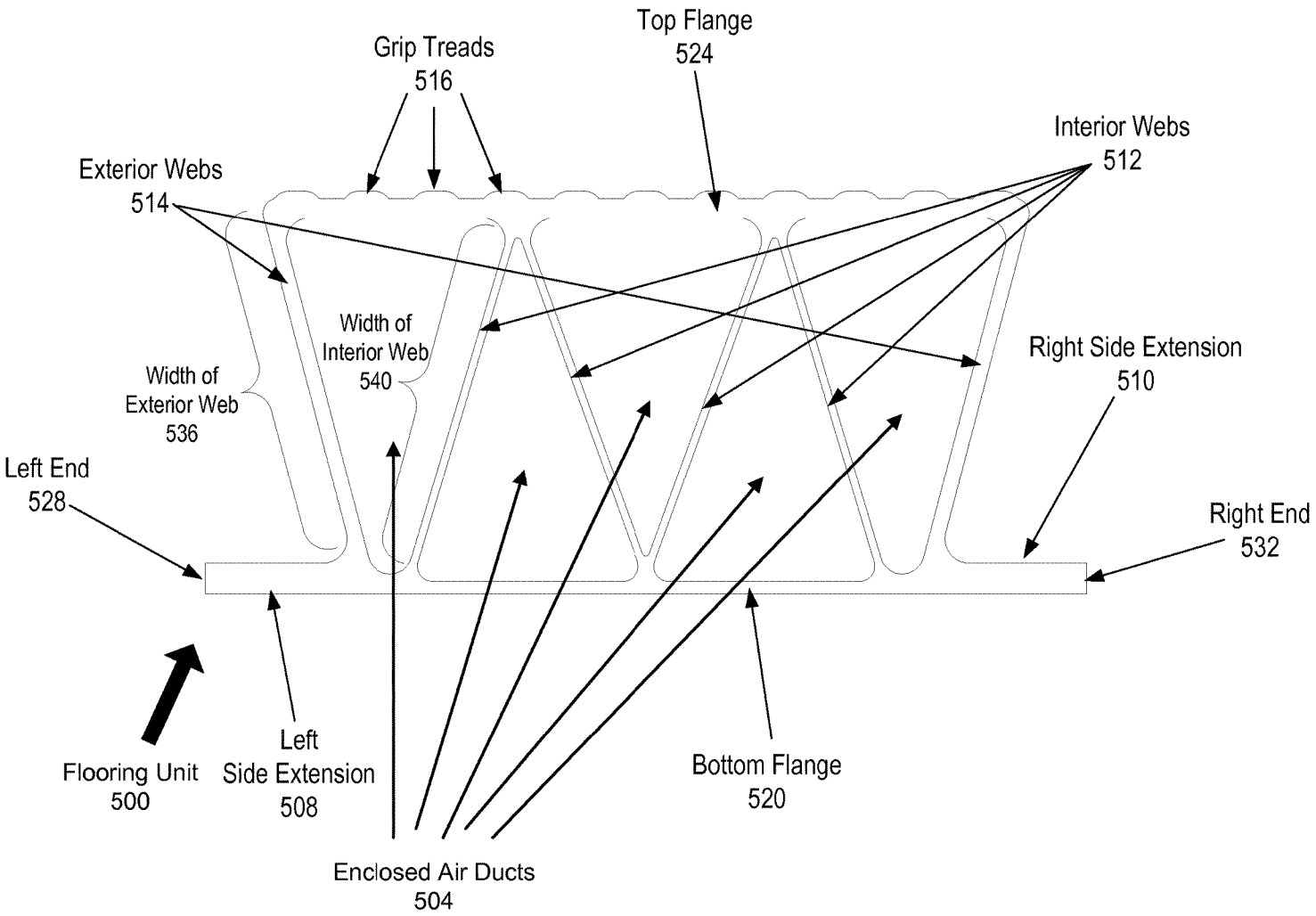

FIG. 5 depicts an example cross-section of a flooring unit in accordance with various embodiments.

Figure 6:
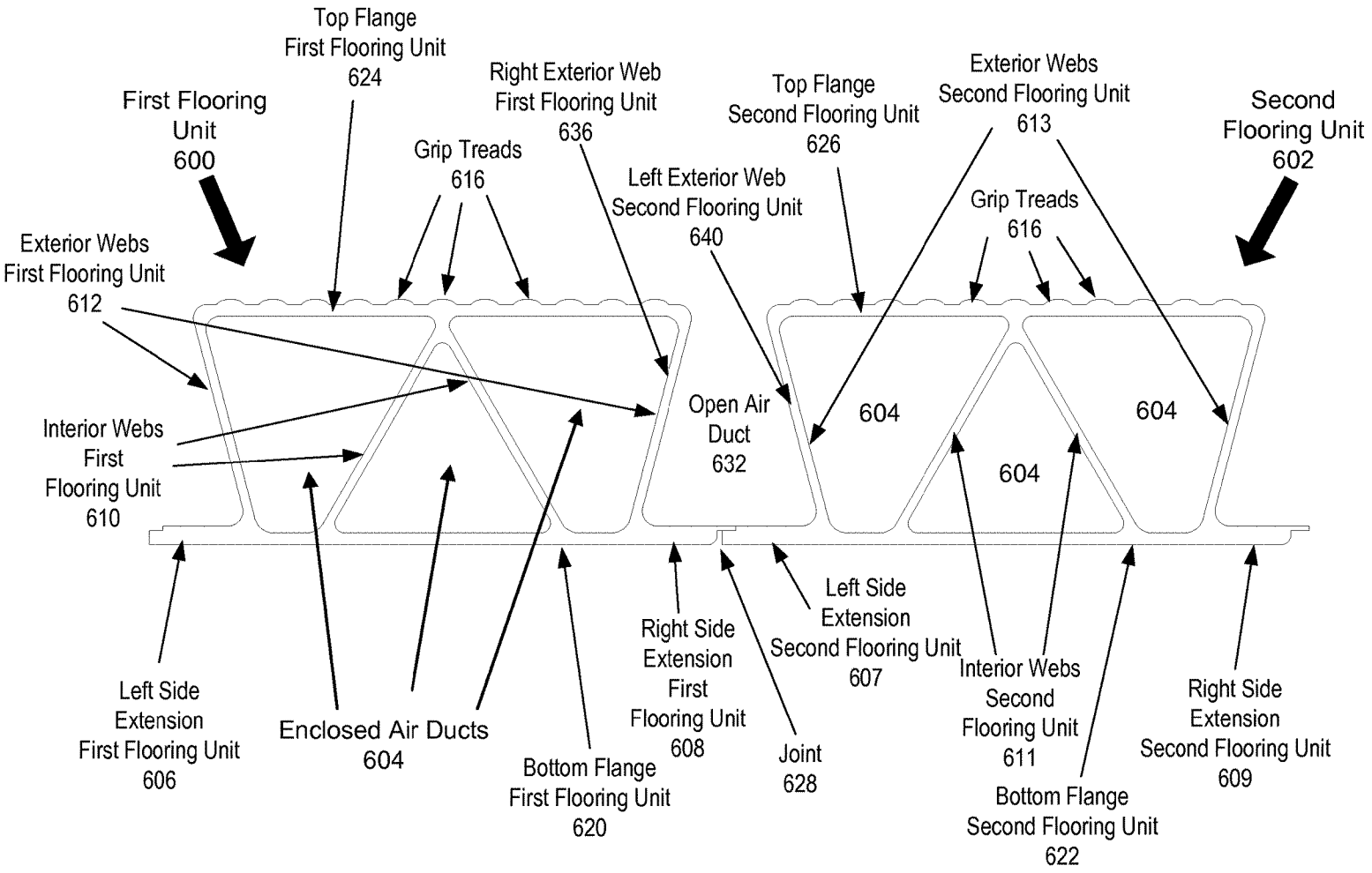

FIG. 6 depicts an example cross-section of two interconnected flooring units in accordance with various embodiments.

DETAILED DESCRIPTION

In the following description of the various embodiments, reference is made to the accompanying drawings, which form a part hereof, and in which is shown by way of illustration the various embodiments in which aspects described herein may be practiced. It is to be understood that other embodiments may be utilized and structural and functional modifications may be made without departing from the scope and spirit of the present disclosure.

FIG. 1 is an example perspective view of a railcar floor 104 within a railcar 100. The railcar 100 comprises a railcar floor 104, side walls 108, insulation panel 112, and an underframe 116. The railcar 100 may comprise any type of track engaging car used for transporting a lading. In one embodiment, the railcar 100 comprises a refrigerated insulated box car. The refrigerated insulated box car may be used to carry a lading, such as perishable goods from one location to another. The railcar floor 104 may be attached to an insulation panel 112 by way of mechanical fasteners or by way of application of an adhesive, for example. The insulation panel 112 may comprise a foam panel comprising any type of insulation foam partially surrounded or completely surrounded by a skin. The insulation panel 112 may be laid, attached, or affixed onto the underframe 116 of the railcar 100. The underframe 116 may be constructed from steel, aluminum, or any type of metallic material. The underframe 116 may comprise steel skeleton members, for example. As illustrated in FIG. 1, the railcar floor 104 and insulation panel 112 may be situated between the side walls 108 of the railcar 100. The insulation panel 112 and/or railcar floor 104 may be secured to the side walls 108 of the railcar 100. The railcar floor 104 comprises a plurality of elongated flooring units 120. FIG. 1 depicts an embodiment of a railcar floor 104 implemented using a total of fifteen flooring units 120 longitudinally laid on top of the insulation panel 112. Each of the fifteen flooring units 120 comprises an enclosed air duct that directs the flow of air longitudinally through each of the flooring units 120. Thus, FIG. 1 depicts fifteen elongated enclosed air ducts. When refrigerated air is blown into the enclosed air duct, the cold air may cool the top flange of the flooring unit such that any lading that sits on top of the top flange may be cooled by way of conduction through the top flange. The number of flooring units 120 may be varied in other embodiments based on the distance between the side walls 108, the width of each of the flooring units 120, and/or other considerations, for example.

In the embodiment illustrated in FIG. 1, each of the flooring units 120 comprises an enclosed air duct formed by two webs and two flanges. In this embodiment, the cross-section of the enclosed air duct comprises a trapezoid. The enclosed air duct may be open at each of the two ends of each of the flooring units 120 to facilitate circulation of air through the enclosed air duct. Air may be circulated into the enclosed air duct from a refrigeration or air conditioning unit of the refrigerated insulated box car. As illustrated, each of the two webs of the enclosed air duct may be tapered such that the gap or horizontal distance between the pair of webs decreases when going from the top of the flooring unit 120 to the bottom of the flooring unit 120. In other words, the two webs may be configured relative to each other such that the distance between the two webs increases as a function of the distance from the bottom of the flooring unit 120. The distance may be measured from the bottom surface of the flooring unit 120 in the direction of a normal vector pointing upward from the bottom surface.

As depicted in the embodiment of FIG. 1, the connection of two elongated flooring units 120 forms an elongated open air duct. The open air duct may be formed by connecting or concatenating the side extensions of two flooring units 120. By way of connecting the two side extensions, a bottom flange of the open air duct may be formed, as described in connection with FIG. 4. In addition to the bottom flange, the open air duct is formed by using a right web (or left web) of a first of two flooring units 120 and a left web (or right web) of a second of two flooring units 120. In one embodiment, the webs of the open air duct may be tapered such that the gap or horizontal distance between the webs increases when going from the top of the flooring unit 120 to the bottom of the flooring unit 120.

FIG. 2 depicts an example cross-section of a railcar floor 204 within a railcar 200. The railcar 200 comprises a railcar floor 204, side walls 208, insulation panel 212, and an underframe 216. In one example embodiment, the railcar 200 comprises a refrigerated insulated box car which may be used to carry perishable lading from one location to another. The railcar floor 204 may be situated on top of the insulation panel 212. The insulation panel 212 may be situated on top of the underframe 216. As depicted in FIG. 2 and as previously described in FIG. 1, the railcar floor 204 comprises a plurality of elongated flooring units 220. The railcar floor 204 and the insulation panel 212 may be positioned between the side walls 208 of the railcar 200. FIG. 2 depicts a total of fifteen flooring units 220 placed on top of the insulation panel 212. Each of the flooring units 220 comprises an elongated enclosed air duct 228. Depicted in FIG. 2 are an open air duct 224 and an enclosed air duct 228 of a plurality of alternating open and enclosed air ducts. The railcar floor 204 may be formed by way of connecting or concatenating the flooring units together by way of connecting the side extensions of each of the flooring units 220. When two flooring units 220 are connected by way of their side extensions, the side extensions form a bottom flange 232 of the open air duct 224. As previously described in connection with FIG. 1, the two webs (or two sides) of the open air duct 224 may be tapered such that the gap or horizontal distance between the two webs decreases as a function of the distance from the surface of the bottom flange 232 in a direction of a vector that is normal to the surface of the bottom flange 232, wherein the vector points upward from the surface. The gap or horizontal distance may be measured in a line that is parallel to the surface of the bottom flange. For example, in an embodiment where the height or thickness of the flooring units 220 is 4 inches, the distance between the two webs at a height of one inch from the bottom of the floor would be greater than the distance between the two webs at a height of two inches from the bottom of the floor. As illustrated, the open air duct 224 may be formed by way of a bottom flange 232 and two upwardly narrowing webs. As depicted in the embodiment illustrated in FIG. 2, the open air ducts alternate with the enclosed air ducts. Each of the flooring units 220 comprises an elongated enclosed air duct 228 formed by two webs and two flanges in which a cross-section of the air duct comprises a trapezoid. The enclosed air duct 228 may provide regulation of temperature through conduction by way of circulating air through the enclosed air duct via openings at the two ends of each of the flooring units 220. The open air duct 224 may provide direct exposure to air underneath the lading being transported by the railcar 200. In one embodiment, the airflow of each enclosed air duct 228 in the railcar floor 204 may be regulated by way of varying the size of one or both openings at the ends of each enclosed air duct 228. In one embodiment, the airflow of each enclosed air duct 228 may be regulated by way of closing or capping one or both openings of an enclosed air duct 228.

As illustrated in FIG. 2, the two webs that form an enclosed air duct 228 may be tapered such that the gap or distance between the two webs increases with distance from the bottom of a flooring unit. The distance may be measured from the bottom flange 236 of the enclosed air duct or flooring unit in an upwards direction normal to the surface of the bottom flange 236. Each of the flooring units 220 may be constructed from any type of metallic material. In one embodiment, each of the flooring units 220 may be extruded or constructed from aluminum. Each of the flooring units 220 may be extruded and connected together to form the unitized railcar floor 204 depicted in FIG. 2. In one embodiment, the height or thickness of the railcar floor 204 (i.e., the normal distance between the top flange to the bottom flange) may range from about 2 inches to about 6 inches.

FIG. 3 depicts an example cross-section of a flooring unit 300. The flooring unit 300 corresponds to each of the flooring units 120, 220 previously described in connection with FIGS. 1 and 2. In one embodiment, the length (as measured longitudinally, in the direction of the air flow in the flooring unit 300) of the flooring unit 300 may range from about 8 feet to about 80 feet, for example. The flooring unit 300 may be extruded in lengths from about 8 feet to about 80 feet, for example. The flooring unit 300 comprises a top flange 304, a bottom flange 308, a left web 312, a right web 316, a left side extension 320, and a right side extension 322. As illustrated in FIG. 3, the webs 312, 316 and flanges 304, 308 provide a trapezoidal cross-section. The trapezoidal volume or space enclosed by the top flange 304, bottom flange 308, left web 312, and right web 316 provides an enclosed air duct 324. The enclosed air duct 324 may be divided into a plurality of secondary enclosed air ducts. In one embodiment, the enclosed air duct 324 may be divided into five enclosed air ducts, as described in connection with FIG. 5. In one embodiment, the enclosed air duct 324 may be divided into three enclosed air ducts, as illustrated in FIG. 6. In one embodiment, the trapezoidal cross-section comprises an isosceles trapezoid. In this embodiment, each of interior angle BAD (∡BAD) and interior angle ADC (∡-ADC) comprises an obtuse angle. In one embodiment, each of the obtuse interior angles (∡BAD, ∡ADC) comprises an angle from about 100 to about 135 degrees. In one embodiment, each of the obtuse interior angles (∡BAD, ∡ADC) comprises 105 degrees. As illustrated, the side extensions 320, 322 may extend laterally from the bottom flange 308. As was previously described in FIGS. 1 and 2, an end of one of the side extensions 320 (or 322) of the flooring unit 300 may be used for connecting to an end of a side extension 322 (or 320) of another flooring unit 300. The ends 332, 336 of each of the left side extension 320 and the right side extension 322 may be configured to allow mating or connecting of one flooring unit 300 to another flooring unit 300. The left end 332 of a first flooring unit 300 and the right end 336 of a second flooring unit 300 may be configured to allow a connection of the two flooring units by way of a butt joint. In another embodiment, the left end 332 of a first flooring unit 300 and the right end 336 of a second flooring unit 300 may be configured to allow a connection of the two flooring units by way of a lap joint.

In one embodiment, two or more flooring units may be extruded in one piece which eliminates the presence of joints. The extruded piece may comprise multiple flooring units and may be termed a "multiple flooring units extrusion." One or more joints may be formed when connecting or concatenating two or more multiple flooring units extrusions together. A joint may be formed when connecting a right (or left) side extension of a multiple flooring units extrusion to a left (or right) side extension of another multiple flooring units extrusion. For example, two flooring units may be extruded as a single extrusion such that a joint is absent between the two flooring units. When such multiple flooring units extrusions are connected or concatenated to make a floor, a joint will be formed where the multiple flooring units extrusions are connected to each other (i.e., at the ends of their side extensions).

As illustratively depicted, the distance between the left web 312 and the right web 316 increases with the distance from the bottom flange 308 in an upward direction normal to the surface of the bottom flange 308. For example, the distance from E to E' 340 is greater than the distance from F to F' 344.

While not shown in FIG. 3, the internal structure of the flooring unit 300 may comprise one or more interior webs. The one or more interior webs may divide the enclosed air duct 324 into a plurality of smaller enclosed air ducts. Optionally, by way of varying the size of one or both openings at the ends of each of the plurality of smaller enclosed air ducts, the airflow in each of the smaller enclosed air ducts may be independently regulated. In one embodiment, the flooring unit 300 may comprise a middle web (not shown in FIG. 3) that is connected from a midpoint of the top flange 304 to a midpoint of the bottom flange 308. The middle web may divide the enclosed air duct 324 into two equally sized enclosed air ducts. In one embodiment, the flooring unit 300 may be divided into five smaller enclosed ducts as described in connection with FIG. 5. In one embodiment, the flooring unit 300 may be divided into three smaller enclosed ducts as described in connection with FIG. 6. Additional interior web configurations, which divide the enclosed air duct 324 into a plurality of smaller enclosed air ducts, are contemplated. For the sake of brevity, the present disclosure does not explicitly recite each and every interior web configuration which may be implemented.

A railcar floor may be constructed by way of concatenating a plurality of flooring units. The side extensions 320, 322 may be connected together by way of welding the side extensions 320, 322 together, by way of mechanically fastening the side extensions 320, 322 together, or by way of applying an adhesive to each of the extensions 320, 322. The welding may be accomplished by friction stir welding. The top flange 304 may comprise grip treads 328 for providing an anti-slip surface for the lading. The grip treads 328 may prevent slippage of the lading while the lading is being transported. The grip treads 328 may also prevent slippage of the lading while the lading is being loaded and unloaded. The grip treads 328 may prevent slippage of the lading in any direction. The grip treads 328 may comprise protrusions from the top flange 304 that are formed when a flooring unit 300 is manufactured. The grip treads 328 may comprise a material that may be attached to the top flange 304. The grip treads 328 may comprise strips which may be attached to the top flange 304 using an adhesive, for example.

In one embodiment, the length of the top flange 304 may range anywhere from about 3 inches to about 12 inches. Each of the left web 312 and right web 316 may have a web thickness anywhere from about one-sixteenth of an inch to about three-quarters of an inch. The thickness of the top flange 304 may range anywhere from about one-eighth of an inch to about one-quarter of an inch while the thickness of the bottom flange 308 may range anywhere from about one-sixteenth of an inch to about one-half of an inch. The thickness of either the left side extension 320 or the right side extension 322 may range anywhere from about one-eighth of an inch to about one-half of an inch. The length of each of the left side extension 320 or the right side extension 322 may range anywhere from about one-half inch to about 1.5 inches. The length of the bottom flange 308 (not including the side extensions 320, 322) may range anywhere from about 2 inches to about 11 inches. The length of each of the left web 312 and the right web 316 may range anywhere from about 1.5 inches to about 6 inches. It should be understood that the dimensions noted herein are exemplary and are not meant to be limiting.

FIG. 4 depicts an example cross-section of interconnected flooring units. FIG. 4 illustrates three flooring units in which a first flooring unit 400 is connected to a second flooring unit 404 and a second flooring unit 404 is connected to a third flooring unit 408. Each of the flooring units 400, 404, 408 may correspond to the flooring unit 300 as previously described in connection with FIG. 3. The flooring units 400, 404, 408 may be connected together by way of their respective side extensions 432. An open air duct flange 428 may be formed by connecting two side extensions 432 to form a joint 440. The two side extensions 432 form the bottom flange of the open air duct. As illustrated in FIG. 4, the distance between the two webs 436 decreases as a function of the distance from the surface of the bottom flange 428 in a direction of a vector that is normal to the surface of the air duct flange 428 and is pointed upward from the surface of the open air duct flange 428. The distance between the two webs 436 (i.e., inter-web distance) may be measured in a line that is parallel to the surface of the open air duct flange 428. As depicted in FIG. 4, the inter-web distance 424 at the top of an open air duct 412 (i.e., between the first vertex 416 and the second vertex 420) is less than the inter-web distance 424 near or at the bottom of the open air duct 412. Of course, in another embodiment, multiple flooring units may be extruded together in one piece which eliminates the presence of joints 440 which occurs when the flooring units 400, 404, 408 are connected by using their respective side extensions 432.

FIG. 5 depicts an example cross-section of a flooring unit 500. The flooring unit 500 comprises five enclosed air ducts 504 formed by four interior webs 512 and two exterior webs 514. In one embodiment, the length (as measured longitudinally, in the direction of the air flow within the enclosed air ducts 504 of the flooring unit 500) of the flooring unit 500 may range from about 8 feet to about 80 feet, for example. The flooring unit 500 may be extruded in lengths from about 8 feet to about 80 feet, for example. The flooring unit 500 further comprises a left side extension 508 and a right side extension 510. A railcar floor may be formed by way of connecting or concatenating a plurality of flooring units together by way of connecting their respective side extensions 508, 510 at their respective ends 528, 532. When connected, the side extensions 508, 510 may form a joint. The joint may comprise a butt joint, lap joint, or any other type of joint. In one embodiment, each of the five enclosed air ducts 504 may be opened or closed by way of closing or capping one or both ends of each of the five air ducts 504. In another embodiment, the opening at each end of each of the five enclosed air ducts 504 may be varied in size to regulate the flow of air within each of the five enclosed air ducts 504. Thus each of these five enclosed air ducts 504 may be independently regulated. As depicted in FIG. 5, the exterior webs 514, the bottom flange 520, and the top flange 524 form a trapezoidal space containing the five enclosed air ducts 504. A cross-section of the exterior webs 514, the bottom flange 520, and the top flange 524 forms a trapezoid such as the isosceles trapezoid described in connection with FIG. 3. The top flange 524 may be configured with grip treads 516 on a side of the top flange 524 facing the lading. The grip treads 516 may prevent slippage of the lading when the lading is transported by railcar. The number and thickness of the grip treads 516 may vary based on the type of lading and transport requirements. The grip treads 516 may comprise the features and aspects of the grip treads 328 previously described in connection with FIG. 3. It should be understood that the five enclosed air ducts 504 depicted in FIG. 5 are exemplary and are not meant to limit the scope of the present disclosure.

In one embodiment, the width of the top flange 524 may range anywhere from about 3 inches to about 12 inches. Each of the exterior webs 514 may comprise a web thickness anywhere from about one-sixteenth inch to about three-quarters of an inch. The thickness of the top flange 524 may range anywhere from about one-eighth of an inch to about one-half inch while the thickness of the bottom flange 520 may range anywhere from about one-sixteenth of an inch to about one-half inch. The thickness of either the left side extension 508 or the right side extension 510 may range anywhere from about one-eighth of an inch to about one-half inch. The width of each of the left side extension 508 or the right side extension 510 may range anywhere from about one-sixteenth of an inch to about 1.5 inches. The width of the bottom flange 520 (not including the side extensions 508, 510) may range anywhere from about 2 inches to about 11 inches. The width 536 of each of the exterior webs 514 may range anywhere from about 1.5 inches to about 6 inches. The thickness of each of the interior webs 512 may range anywhere from about one-sixteenth of an inch to about one-half inch. The width 540 of each of the interior webs 512 may range anywhere from about 1.5 inches to about 6 inches. It should be understood that the dimensions noted herein are exemplary and are not meant to be limiting.

Instead of extruding an individual flooring unit 500 as depicted in FIG. 5, an extrusion comprising multiple flooring units may occur by way of using an appropriate extrusion die. In such an embodiment, joints would be absent between flooring units of the multiple flooring units extrusion. One or more joints may be formed when connecting or concatenating two or more multiple flooring units extrusions together. A joint may be formed when connecting a right (or left) side extension of a multiple flooring units extrusion to a left (or right) side extension of another multiple flooring units extrusion. The side extensions of such multiple flooring units extrusions may be used to connect or concatenate multiple flooring units extrusions together to form a floor. Each connection between two multiple flooring units extrusions would produce a joint. The joint may comprise a lap joint or a butt joint, for example.

FIG. 6 depicts an example cross-section of two interconnected flooring units 600, 602. In this embodiment, each of the flooring units 600, 602 comprises three enclosed air ducts 604 formed by two interior webs 610, 611 and two exterior webs 612, 613. In one embodiment, the length of each of the interconnected flooring units 600, 602 may range from about 8 feet to about 80 feet, for example. Each of the flooring units 600, 602 may be extruded in lengths from about 8 feet to about 80 feet, for example. In one embodiment, a cross-section of each of the three enclosed air ducts 604 may comprise three triangles. In one embodiment, a cross-section of each of the flooring units 600, 602 may comprise at least one equilateral triangle. Each of the flooring units 600, 602 further comprises left side extensions 606, 607 and right side extensions 608, 609. A railcar floor may be formed by way of connecting or concatenating the flooring units 600, 602 together by way of connecting their respective side extensions 607, 608. As illustrated in FIG. 6, the side extensions 607, 608 may be connected together to form a joint 628, such as a lap joint, for example. In one embodiment, one or more of the three enclosed air ducts 604 may be opened or closed by way of closing or capping one or both ends of one or more of the three enclosed air ducts 604. In another embodiment, openings at the ends of the three enclosed air ducts 604 may be varied in size to regulate the flow of air within each of the three enclosed air ducts 604. Thus each of these three enclosed air ducts 604 may be independently regulated. Refrigerated air may be directed into one or more of the three enclosed air ducts 604. As depicted in FIG. 6, the exterior webs 612, 613, the bottom flange 620, 622, and the top flange 624, 626 of each flooring unit 600, 602 enclose a trapezoidal space or volume containing the three enclosed air ducts 604. In one embodiment, a cross-section of the exterior webs 612, 613, bottom flange 620, 622, and top flange 624, 626 for each of the first flooring unit 600 and the second flooring unit 602 forms a trapezoid such as the isosceles trapezoid described in connection with FIG. 3. An open air duct 632 may be formed by connecting the two flooring units 600, 602 as shown in FIG. 6. The geometry of the open air duct 632 may be similar to that of each of the open air ducts 412 described in connection with FIG. 4. As illustrated in FIG. 6, the right exterior web 636 of the exterior webs 612 of the first flooring unit 600, the left exterior web 640 of the exterior webs 613 of the second flooring unit 602, the right side extension 608 of the first flooring unit 600, and the left side extension 607 of the second flooring unit 602 form the sides or boundaries of the open air duct 632. When the flooring units 600, 602 are connected together, the right side extension 608 of the first flooring unit 600 and the left side extension 607 of the second flooring unit 602 form an open air duct flange of the open air duct 632.

The geometry of the open air duct 632 may be such that a first distance between the right exterior web 636 and the left exterior web 640 decreases as a function of a second distance. The second distance may be measured in a direction of a vector normal to the surface of the open air duct flange, in which the vector points upwards from the surface or the open air duct flange, in which the first distance is measured along a line parallel to the surface of the open air duct flange. Each of the top flanges 624, 626 may be configured with grip treads 616 on a side of the top flange 624, 626 that faces the lading. The grip treads 616 may prevent slippage of the lading when the lading is transported by railcar. The number and thickness of the grip treads 616 may be varied based on the type of lading and transport requirements. The grip treads 616 may comprise the features and aspects of the grip treads 328, 516 described in connection with FIGS. 3 and 5. It should be understood that the presence of three enclosed air ducts 604 depicted in each of the first flooring unit 600 and second flooring unit 602 are exemplary and are not meant to limit the scope of the present disclosure. It should be understood that in other embodiments, the trapezoidal space enclosed by each of the flooring units 600, 602 may be configured with any number of enclosed air ducts. Further, it is contemplated that the geometry of the enclosed air ducts may vary in other embodiments.

In one embodiment, the width of each of the top flanges 624, 626 may range anywhere from about 3 inches to about 12 inches. Each of the exterior webs 614 may comprise a web thickness anywhere from about one-sixteenth of an inch to about three-quarters of an inch. The thickness of the top flange 624, 626 may range anywhere from about one-eighth of an inch to about one-half inch while the thickness of the bottom flange 620, 622 may range anywhere from about one-sixteenth of an inch to about one-half inch. The thickness of either the left side extension 606, 607 or the right side extension 608, 609 may range anywhere from about one-eighth of an inch to about one-half inch. The width of either the left side extension 606, 607 or the right side extension 608, 609 may range anywhere from about one-eighth of an inch to about 1.5 inches. The width of each of the bottom flanges 620, 622 (not including the widths of the side extensions 606, 607, 608, 609) may range anywhere from about 2 inches to about 11 inches. The width of each of the exterior webs 612, 613 may range anywhere from about 1.5 inches to about 6 inches. The thickness of each of the interior webs 610, 611 may range anywhere from about one-sixteenth of an inch to about one-half inch. The width of each of the interior webs 610, 611 may range anywhere from about 1.5 inches to about 6 inches. It should be understood that the dimensions noted herein are exemplary and are not meant to be limiting.

Instead of extruding an individual flooring unit 600, 602, an extrusion comprising multiple flooring units may occur by way of using an appropriate extrusion die. In such an embodiment, joints would be absent between flooring units of the multiple flooring units extrusion. One or more joints may be formed when connecting or concatenating two or more multiple flooring units extrusions together. A joint may be formed when connecting a right (or left) side extension of a multiple flooring units extrusion to a left (or right) side extension of another multiple flooring units extrusion. The side extensions of such multiple flooring units extrusions may be used to connect or concatenate multiple flooring units extrusions together to form a floor. Each connection between two multiple flooring units extrusions would produce a joint. The joint may comprise a lap joint or a butt joint, for example.

In one embodiment, a multiple flooring units extrusion may comprise two (dual) flooring units. The embodiment may be illustratively described by FIG. 6 except that joint 628 would be absent. In addition, the right side extension of the first flooring unit 608 and the left side extension of the second flooring unit 607 would be replaced by a bottom flange of the open air duct 632.

While aspects of the disclosure have been described in terms of illustrative embodiments thereof, it will be understood by those skilled in the art that the disclosure is not limited to these embodiments. It is contemplated that the embodiments described herein are susceptible to many modifications of form, arrangement, of parts, details and order of operation and that there are numerous other embodiments, modifications, and variations of the disclosure that fall within the scope and spirit of the disclosure from a review of this entire disclosure. Furthermore, for example, the railcar floor may be adapted for use in an intermodal container, a truck, a boat, a vessel, or any other container or vehicle. The flooring units described may be varied based on particular use requirements. While some embodiments have been described with respect to specific examples, other embodiments include numerous variations and permutations of the above described systems and techniques.

Although the subject matter has been described in language specific to structural features and/or methodological acts, it is to be understood that the subject matter defined in the appended claims is not necessarily limited to the specific embodiments and/or features described above. Rather, the specific embodiments and/or features described above are disclosed as illustrative forms of implementing the claims that follow.

What is claimed is:

1. A floor comprising:

a plurality of interconnected elongated flooring units;

wherein each of said elongated flooring units comprises an enclosed air duct, said enclosed air duct formed by a left web, a right web, a top flange, and a bottom flange;

wherein a cross-section of said enclosed air duct comprises a trapezoid, said top flange and said bottom flange comprising parallel sides of said trapezoid; and wherein a material used to construct said flooring unit comprises aluminum.

2. The floor of claim 1, wherein said trapezoid comprises an isosceles trapezoid.

3. The floor of claim 2, wherein said bottom flange and one of said left and right webs form an interior angle of said trapezoid, wherein said interior angle is an obtuse angle.

4. The floor of claim 3 wherein said obtuse angle is in a range from about 100 degrees to about 135 degrees.

5. The floor of claim 4 wherein said obtuse angle is 105 degrees.

6. The floor of claim 1 wherein interconnecting two of said flooring units forms an open air duct.

7. The floor of claim 1 wherein said plurality of interconnected elongated flooring units are positioned longitudinally in a railcar.

8. A floor comprising:

a plurality of alternating enclosed air ducts and open air ducts formed by interconnecting a plurality of flooring units, wherein each enclosed air duct of said enclosed air ducts is formed by two webs and two flanges of each flooring unit of said plurality of flooring units, said two flanges comprising a bottom flange and a top flange, wherein each open air duct of said open air ducts comprises:

a web of a first flooring unit;

a web of a second flooring unit;

an open air duct flange, wherein a first distance between said web of said first flooring unit and said web of said second flooring unit decreases as a function of a second distance, said second distance measured in a direction of a vector that is normal to the surface of said open air duct flange, said vector pointing upwards from said surface, said first distance measured along a line parallel to said surface of said open air duct flange.

9. The floor of claim 8 wherein a cross-section of said each enclosed air duct comprises a trapezoid, said two flanges comprising parallel sides of said trapezoid.

10. The floor of claim 8 wherein the airflow of at least one of said enclosed air ducts is regulated by way of varying the size of an opening at an end of said at least one of said enclosed air ducts.

11. The floor of claim 8 wherein said open air duct flange comprises:

a first side extension of said first flooring unit of said flooring units, and a second side extension of said second flooring unit of said flooring units; and wherein said first side extension is connected to said second side extension by way of forming one of: a butt joint and a lap joint.

12. The floor of claim 8 wherein each of said enclosed air ducts is divided into a plurality of secondary enclosed air ducts using one or more interior webs, wherein the airflow of each of said secondary enclosed air ducts is independently regulated.

13. The floor of claim 8 wherein said floor is used in a railcar.

14. A floor comprising:

a plurality of interconnected elongated flooring units, wherein each of said elongated flooring units comprises:

a left web;

a right web;

a top flange; and a bottom flange, said top and bottom flanges parallel to each other, wherein said webs and said flanges are configured to form an enclosed air duct facilitating airflow from a first end of said enclosed air duct to a second end, wherein said each of said elongated flooring units is configured for connecting to two adjacent flooring units by way of connecting to side extensions extending from said bottom flange;

wherein the horizontal distance between said left web and said right web increases as a function of the distance in an upward direction normal to the surface of said bottom flange; and wherein said each of said flooring units further comprises a web that is connected to a midpoint of said top flange and a midpoint of said bottom flange, and wherein said web divides said enclosed air duct into two equally sized enclosed air ducts.

15. The floor of claim 14 wherein said plurality of interconnected elongated flooring units comprises a plurality of open air ducts.

16. The floor of claim 14 wherein said connecting to said side extensions is performed by way of applying an adhesive.

17. The floor of claim 14 wherein said connecting to said side extensions is performed by way of welding.

18. The floor of claim 14 wherein said connecting to said side extensions is performed by way of using mechanical fasteners.

19. The floor of claim 14 wherein said airflow is regulated by way of varying the size of an opening at said one of said ends of said enclosed air duct.

20. The floor of claim 14 wherein said airflow is regulated by way of varying the size of an opening at each of said two equally sized enclosed air ducts.

21. The floor of claim 14 wherein each of said flooring units comprises a plurality of secondary webs which divide said enclosed air duct into a plurality of secondary enclosed air ducts.

22. The floor of claim 21 wherein said plurality of secondary enclosed air ducts comprises five equally sized secondary enclosed air ducts.

23. The floor of claim 21 wherein said plurality of enclosed air ducts comprises three secondary enclosed air ducts.

24. The floor of claim 21 wherein said airflow is regulated by way of varying the size of an opening at each of said plurality of secondary enclosed air ducts.

25. The floor of claim 14 wherein said floor is used in a railcar.

26. The floor of claim 25 wherein said railcar comprises a refrigerated insulated box car.

27. An elongated flooring unit comprising:

a left web;

a right web;

a top flange;

a bottom flange, said top flange positioned parallel to said bottom flange; and wherein said left and right webs, and said top and bottom flanges, enclose an air space configured for use as an air duct; and wherein said elongated flooring unit comprises one or more interior webs that divides said air duct into a plurality of secondary air ducts.

28. The elongated flooring unit of claim 27, wherein a cross-section of said elongated flooring unit comprises a trapezoid.

29. The elongated flooring unit of claim 27 wherein airflow within said air duct is regulated by way of varying the size of an opening to said air duct at one or both ends of said air duct.

30. The elongated flooring unit of claim 27 wherein each of said plurality of secondary air ducts may be independently regulated by way of varying the size of an opening at one or both ends of each of said plurality of secondary air ducts.

31. The elongated flooring unit of claim 27 wherein said plurality of secondary air ducts comprises three air ducts.

32. The elongated flooring unit of claim 31 wherein a cross-section of at least one of said plurality of secondary air ducts comprises an equilateral triangle.

33. The elongated flooring unit of claim 27 wherein said elongated flooring unit is used to implement a railcar floor.

34. The elongated flooring unit of claim 33 wherein said railcar comprises a refrigerated insulated box car.

35. A floor comprising:

a plurality of alternating enclosed air ducts and open air ducts formed by interconnecting a plurality of flooring units, wherein each enclosed air duct of said enclosed air ducts is formed by two webs and two flanges of each flooring unit of said plurality of flooring units, said two flanges comprising a bottom flange and a top flange, wherein each of said enclosed air ducts is divided into a plurality of secondary enclosed air ducts using one or more interior webs, wherein the airflow of each of said secondary enclosed air ducts is independently regulated.

36. The floor of claim 35 wherein a cross-section of said each enclosed air duct comprises a plurality of triangles.

37. The floor of claim 35 wherein each open air duct of said open air ducts comprises:

a web of a first flooring unit;

a web of a second flooring unit; and an open air duct flange.

38. The floor of claim 37 wherein a first distance between said web of said first flooring unit and said web of said second flooring unit decreases as a function of a second distance, said second distance measured in a direction of a vector that is normal to the surface of said open air duct flange, said vector pointing upwards from said surface, said first distance measured along a line parallel to said surface of said open air duct flange.

39. The floor of claim 37 wherein said open air duct flange comprises:

a first side extension of a first flooring unit of said flooring units, and a second side extension of a second flooring unit of said flooring units; and wherein said first side extension is connected to said second side extension by way of forming one of: a butt joint and a lap joint.

40. The floor of claim 35 wherein said floor is used in a railcar.

* * * * *